United States Patent [19]

Kenny et al.

[11] 4,370,147

[45] Jan. 25, 1983

[54] FUEL FOR COMPRESSION IGNITION ENGINES

[75] Inventors: Thomas C. Kenny, Syosset; John P. Plunkett, Smithtown, both of N.Y.

[73] Assignee: Horizon Chemical, Inc., Freeport, N.Y.

[21] Appl. No.: 81,016

[22] Filed: Oct. 1, 1979

[51] Int. Cl.[3] ..... C10L 1/18; C10L 1/22; C10L 1/30

[52] U.S. Cl. ..... 44/68; 44/57; 44/74; 44/75

[58] Field of Search ..... 44/57, 68, 74, 75

[56] References Cited

U.S. PATENT DOCUMENTS

| | | | |
|---|---|---|---|
| 1,423,050 | 7/1922 | Tunison | 44/74 |
| 3,003,859 | 10/1961 | Irish et al. | 44/57 |
| 3,434,814 | 3/1969 | Dubeck et al. | 44/75 |
| 4,073,626 | 2/1978 | Simmons | 44/57 |

*Primary Examiner*—Jacqueline V. Howard

*Attorney, Agent, or Firm*—Scully, Scott, Murphy & Presser

[57] ABSTRACT

Fuel consumption in compression ignition engines is significantly reduced by the addition to fuel for operating said engines of from about $1.0\times10^{-6}$ to about $1.0\times10^{-3}$ parts by weight of at least one isomer of dinitrotoluene. Optionally, the fuel may further contain an amount of at least one metal acetylacetonate to effect an appreciable reduction in the level of combustion particulates which are produced upon ignition of the fuel.

16 Claims, No Drawings

FUEL FOR COMPRESSION IGNITION ENGINES

BACKGROUND OF THE INVENTION

1. Field of the Invention

The present invention relates to fuels for internal combustion engines and, more particularly, to such fuels containing an additive ingredient which significantly improves the operating economy and performance of compression ignition (diesel) engines.

2. Description of the Prior Art

Almost from the inception of the internal combustion engine and certainly from the time of its widespread use, numerous proposals have been advanced for improving one or another performance characteristic of the engine by incorporating one or more additives in the hydrocarbon fuels used in its operation. Among such additives have been various nitro-containing organic compounds, sometimes used for the purpose of increasing the energy content of the fuels and at other times used for the purpose of improving the ignition characteristics of the fuels. German Patent No. 164,634 (1903) discloses gasoline to which has been added as an energy booster, a nitro compound such as dinitronaphthalene, nitronaphthol, nitroglycerine or picric acid (trinitrophenol). Eckart, *Brennstaff-Chemie,* No. 9. pp. 134–136 (1923) discloses gasoline fuels for racing engines which contain such energy-rich materials as the nitrobenzenes, nitroglycerine, nitronaphthol, dinitronaphthalene, dinitrotoluene and dinitrocellulose in amounts of up to 5%. Similarly, United Kingdom Patent No. 131,869 (1918) proposes the use of a nitro derivative of benzole, toluene, xylol, naphthalene or aniline in such liquid or gaseous combustibles as benzole, petrol, oil, heavy oils, naphtha, and the like.

Specifically with regard to fuels for compression ignition, or diesel, engines, U.S. Pat. No. 1,849,051 (1932) describes the addition of a nitro-containing primer composition to accelerate ignition (i.e., increase the cetane rating) of the fuels. The primer can be trinitrophenol, dinitrophenol, dinitrobenzene, trinitroglycerine or trinitrotoluene. U.S. Pat. No. 2,251,156 (1941) describes a diesel fuel of improved ignition quality containing a nitro compound such as 4- nitro benzene diazo thiophenyl ether or 4-nitro benzene diazo hydrosulfide.

SUMMARY OF THE INVENTION

In accordance with the present invention, a fuel is provided which significantly improves the operating economy and performance of compression ignition (diesel) engines, said fuel containing from about $1.0\times10^{-6}$ to about $1.0\times10^{-3}$ parts by weight thereof of at least one isomer of dinitrotoluene.

It is an additional feature of the invention herein to further include in said fuel an amount of at least one metal acetylacetonate which is effective to appreciably reduce the level of particulates formed during combustion of the fuel and/or significantly inhibit the accumulation of combustion deposits.

DSESCRIPTION OF THE PREFERRED EMBODIMENTS

Any of the known and conventional fuels for the operation of propulsion and stationary diesel engines are suitable for use in the preparation of the fuels of this invention. Table I below sets forth the typical properties of several widely used diesel fuel oils to which a dinitrotoluene isomer or mixture thereof can be added in accordance with the present invention.

TABLE I

| | Average of Selected Properties of Four Classes of Diesel Oils | | | |
|---|---|---|---|---|
| Property | Class 1 Diesel fuel oil for city bus and similar operations | Class 2 Fuels for diesel engines in automobiles, trucks, tractors, and similar operations | Class 3 Fuels for railroad diesel engines | Class 4 Heavy-distillate and residual fuels for large stationary and marine diesel engines |
| Gravity °API | 41.9 | 37.3 | 34.8 | 34.0 |
| Viscosity at 100° F.: Kinematic, CS | 1.84 | 2.54 | 2.74 | 2.79 |
| Saybolt Universal, sec | 32.1 | 34.6 | 35.2 | 35.4 |
| Sulfur content, wt. % | 0.142 | 0.223 | 0.287 | 0.543 |
| Aniline point °F. | 148.6 | 146.2 | 140.2 | 139.3 |
| Ramsbottom carbon residue on 10% residuum, % | 0.057 | 0.088 | 0.117 | 0.163 |
| Ash, % | 0.0005 | 0.0009 | 0.0010 | 0.0023 |
| Cetane number | 51.1 | 50.0 | 47.0 | 46.7 |
| Distillation test: | | | | |
| IBP, °F. | 356 | 380 | 388 | 397 |
| 10%, °F. | 393 | 430 | 440 | 448 |
| 50%, °F. | 440 | 490 | 502 | 509 |
| 90% | 501 | 557 | 574 | 582 |

TABLE I-continued

| Property | Average of Selected Properties of Four Classes of Diesel Oils: Class 1 Diesel fuel oil for city bus and similar operations | Class 2 Fuels for diesel engines in automobiles, trucks, tractors, and similar operations | Class 3 Fuels for railroad diesel engines | Class 4 Heavy-distillate and residual fuels for large stationary and marine diesel engines |
|---|---|---|---|---|
| EP, °F. | 542 | 600 | 618 | 622 |

Such oils may, and frequently do, contain one or more conventional additives, e.g., ignition improvers such as amyl nitrate, starting-aid fluids such as ether or ether and heptane, viscosity modifiers, lubricants, detergents, anti-smoking agents, and so forth.

Any of the dinitrotoluene isomers set forth in Table II below can be used herein, singly or in admixture:

TABLE II

| dinitrotoluene isomer | melting point °C. |
|---|---|
| 2,4-dinitrotoluene | 71 |
| 2,3-dinitrotoluene | 63 |
| 2,5-dinitrotoluene | 48 |
| 2,6-dinitrotoluene | 66 |
| 3,4-dinitrotoluene | 59 |
| 3,5-dinitrotoluene | 92 |

For the sake of economy and convenience, it is preferred to employ the most commonly available isomer, 2,4-dinitrotoluene, which in commerce, is frequently supplied in admixture with a minor amount of 2,6-dinitrotoluene, the latter occurring in the manufacture of the former. In the present invention, a commercially available 80:20 weight mixture of the 2,4 and 2,6 isomers which melts at approximately 56° C. has been found to provide entirely acceptable results.

By themselves, none of the foregoing dinitrotoluene isomers are soluble in diesel fuel and they must therefore be incorporated in the fuel with the aid of a mutual solvent. The choice of mutual solvent is not a critical requirement of the present invention, it only being necessary that the solvent effect the complete dissolution of the dinitrotoluene at its level of concentration in a particular fuel oil medium. Whether a particular substance is suitable for use as a mutual solvent herein can be readily determined employing standard techniques, i.e., solubility testing. Among the mutual solvents which can be advantageously used for this purpose, alone or in admixture, are dimethylformamide, halogenated hydrocarbons such as ortho-dichlorobenzene, trichloropropane and methylene chloride, cyclic ethers such as tetrahydrofuran and dioxolane, tricresyl phosphate, and the like. In general, the minimum amount of mutual solvent which results in complete dissolution of the selected isomer or isomer mixture in a given diesel oil is preferred. Concentrations of isomer in the foregoing solvents ranging from about 5 to about 25 weight percent are usually suitable.

An amount of dinitrotoluene isomer/mutual solvent solution is added to the diesel fuel to provide a final concentration of isomer in the fuel of from about $1.0\times10^{-6}$ to about $1.0\times10^{-3}$ by weight and preferably from about $1.5\times10^{-6}$ to about $1.0\times10^{-5}$ parts by weight.

At levels significantly below $1.0\times10^{-6}$ parts by weight of fuel, the dinitrotoluene isomer will usually be present in the fuel in too small an amount to provide noticeable improvement in engine operating economy; much above $1.0\times10^{-3}$, the dinitrotoluene no longer provides the combustion efficiencies observed at the lower levels of concentration but tends to behave in a completely different way, i.e., as an ignition accelerator or cetane improver. Since most fuels which are treated with dinitrotoluene in accordance with this invention already contain one or more ignition accelerators calculated to provide optimum engine performance, merely contributing to this effect by the addition of dinitrotoluene significantly above $1.0\times10^{-3}$ will often only result in a deterioration of engine performance and fuel economy.

If desired, the dinitrotoluene/mutual solvent solution can be introduced into a small quantity of fuel oil, with the resulting solution thereafter being combined with a larger quantity of fuel.

As shown in the following examples, significant reduction in fuel consumption for a variety of automotive diesel engines were obtained using a fuel in accordance with this invention. In each of these examples, 1 gallon of the following dinitrotoluene/mutual solvent solution in Class 2 diesel fuel oil was dissolved per 1,000 gallons of Class 2 diesel fuel at ambient temperature (Fuel A) and this fuel was then compared with an untreated fuel (Fuel B) under actual in-service conditions.

| Component | Amount (weight ounces) |
|---|---|
| 80:20 weight mixture of 2,4-dinitrotoluene and 2,6-dinitrotoluene | 12.5 |
| dimethylformamide | 64 |
| ortho-dichlorobenzene | 64 |
| methylene chloride | 64 |
| tricresyl phosphate | 8 |
| Class 2 diesel fuel oil | 53.3 gallons |
| | 55 gallons (approx.) |

EXAMPLE 1

In this example, the gallonage used for the identical period of operation of a fleet of twenty-two tractor-trailor units in two successive periods is reported. The units operated over fixed routes in the same geographical area and cumulatively carried about the same amount of freight per mile during both test periods. The results of the test are set forth in Table III as follows:

TABLE III

| Unit | Fuel B First Year: Distance Traveled (miles) | Fuel B First Year: Fuel Consumption (gallons) | Fuel A Second Year: Distance Traveled (miles) | Fuel A Second Year: Fuel Consumption (gallons) |
|---|---|---|---|---|
| 1 | 1278 | 214 | 1216 | 162 |
| 2 | 1477 | 260 | 1079 | 288 |
| 3 | 1054 | 196 | 979 | 118 |
| 4 | 1091 | 204 | 1111 | 140 |

TABLE III-continued

| Unit | Fuel B First Year Distance Traveled (miles) | Fuel B First Year Fuel Consumption (gallons) | Fuel A Second Year Distance Traveled (miles) | Fuel A Second Year Fuel Consumption (gallons) |
|---|---|---|---|---|
| 5 | 1442 | 263 | 1250 | 215 |
| 6 | 1811 | 241 | 1617 | 328 |
| 7 | 1233 | 238 | 1697 | 235 |
| 8 | 2152 | 473 | 1000 | 246 |
| 9 | 2676 | 407 | 2159 | 286 |
| 10 | 997 | 243 | 726 | 152 |
| 11 | 1461 | 279 | 1587 | 325 |
| 12 | 1162 | 191 | 1158 | 219 |
| 13 | 1666 | 416 | 849 | 95 |
| 14 | 644 | 124 | 823 | 252 |
| 15 | 1138 | 162 | 589 | 198 |
| 16 | 1546 | 376 | 921 | 185 |
| 17 | 1345 | 318 | 1077 | 133 |
| 18 | 1242 | 261 | 721 | 172 |
| 19 | 956 | 178 | 1059 | 170 |
| 20 | 1154 | 162 | 1126 | 120 |
| 21 | 919 | 184 | 1483 | 303 |
| 22 | 1057 | 464 | 1075 | 146 |
| Total | 29501 | 5854 | 25302 | 4486 |
| Computed Average miles per gallon | 5.04 | | 5.64 | |

*Tractor vehicle: Mack F763, Cummins engine, 290 h.p., F. Model, single axle.

Employing the dinitrotoluene isomer diesel fuel additive of the present invention, the identical fleet of tractor-trailor units over the identical operating period in two successive years averaged a calculated 11.90% increase in mileage compared to the fleet employed the same fuel but omitting the dinitrotoluene isomer.

EXAMPLE 2

Comparison was made in the identical period of two successive periods between Fuel A of Example 1, which is representative of a Class 2 diesel oil in accordance with the present invention, with an untreated Class 2 diesel oil (designated Fuel B) for operating heavy equipment. The results are set forth in Table IV as follows:

TABLE IV

| Unit | Description | Fuel B First Year Distance Traveled (miles) | Fuel B First Year Fuel Consumption (gallons) | Fuel A Second Year Distance Traveled (miles) | Fuel A Second Year Fuel Consumption (gallons) |
|---|---|---|---|---|---|
| 1 | U600 Mack tractor, 675 max edyne turbocharged engine, 672 in.$^3$, 237 h.p. at 2100 rpm | 7489 | 1826.59 | 8120 | 1845.45 |
| 2 | Same as (1) | 7914 | 2082.63 | 8968 | 2299.49 |
| 3 | B61 Mack flat bed truck, Mack engine, END 673 Mode 1672 in.$^3$, 195 h.p. at 2100 rpm | 8021 | 1706.60 | 7584 | 1613.62 |
| 4 | DM 800 Cummins Model NTC, 335 turbocharged 852 in.$^3$, h.p. at 2100 rpm | 2217 | 615.83 | 2048 | 487.62 |
| 5 | 7000 Ford Caterpillar Engine, 1150 v 200, 573 in.$^3$, 200 h.p. at 3000 rpm | 5713 | 1241.96 | 7936 | 1587.20 |
| 6 | Same as (5) | 6102 | 1419.07 | 8147 | 1697.29 |
| 7 | Same as (5) | 7241 | 1683.95 | 7128 | 1485.00 |
| 8 | Same as (5) | 6328 | 1622.56 | 7840 | 1823.26 |
| 9 | VT 555C, Cummins engine, 550 in.$^3$, 220 h.p. at 2850 rpm | 917 | 183.40 | 1063 | 204.42 |
| 10 | Michigan Payloader | 540 | 580.02 | 863 | 836.00 |
| Total | | 52482 | 12,926.69 | 59670 | 13,879.35 |
| Computed Average Miles per Gallon | | 4.06 | | 4.30 | |

Fuel A in the above comparison study provided an average 5.91% increase in mileage over untreated fuel B.

EXAMPLE 3

Fuel A of Example 1 was compared with an untreated Class 2 diesel fuel oil (Fuel B) in the identical periods of two successive periods in the operation of 27 vehicles of the following numbers and type:

| Number of Units of Each Type | Description |
|---|---|
| 6 | 1979 Chevrolet tractors, turbocharged 6 cyl. 92 series, 270 h.p. |
| 9 | 1976 Mack Mac Scania ET 477 series dump trucks, 160 h.p. |
| 7 | 1978 Chevrolet V-8 backloaders, 71 series, 318 h.p. |
| 5 | 1977 Dodge tractors (snow blowers), 6 cyl., 71 series, 238 h.p. |
| Total Number of Units 27 | |

In the reporting period of the first year of operation, the vehicles traveled a combined 11,204 miles and consumed 2,106.02 gallons of Fuel B for an average fuel consumption of 5.32 miles per gallon of untreated fuel. In the same reporting period of the following year of operation, the vehicles traveled a combined 10,412 miles and consumed 1,795.17 gallons of Fuel A for an average fuel consumption of 5.80 miles per gallon of treated fuel representing a 9% increase in mileage of Fuel A over Fuel B.

In accordance with another embodiment of the present invention, diesel fuel containing from about $1.0\times10^{-6}$ to about $1.0\times10^{-3}$ parts by weight of at least one isomer of dinitrotoluene is further provided with a combustion particulate-reducing amount of at least one metal acetylacetonate. By themselves, neither the dinitrotoluene isomer nor the metal acetylacetonate are capable of reducing combustion particulates and/or inhibiting combustion deposit formation within an engine burning the fuel to any appreciable extent. However, their combined presence in a diesel fuel in accordance with this invention has been found to exert a marked effect on the nature of the combustion emissions, providing a significant reduction in the level of particulates contained in the emissions and in most cases, inhibiting the formation of combustion deposits within the engine or removing such deposits which may have already accumulated with the previous use of untreated fuel.

The useful metal acetylacetonates are in themselves well known compounds (viz. U.S. Pat. No. 2,086,775 (1936)) and are preferably selected from among the metal derivatives of the beta diketones. The metal moieties of such compounds can be advantageously selected from the group consisting of cobalt, nickel, manganese, iron, copper, uranium, molybdenum, vanadium, zirconium, beryllium, platinum, palladium, thorium, chromium, aluminum and the rare earth metals. Beta diketones useful in the preparation of the metal acetyl acetonates can be represented by the structural formula:

$$R_1—CO—CHR_2—COR_3$$

wherein $R_1$ and $R_3$ are hydrocarbon radicals which may carry halogen atoms as substituents, and $R_2$ is a hydrocarbon radical or a hydrogen atom. Specific beta diketones include acetylacetone, which is preferred, benzoylacetone and their alkyl aralkyl or aryl homologs. Useful metal acetylacetonates which can be used herein with good results include, singly or in admixture: nickel propionylacetonate, cobaltous propionylacetonate, cobaltic acetylacetonate, ferric acetylacetonate, cerous propionylacetonate, thorium acetylacetonate, zirconium acetylacetonate, chromic acetylacetonate, aluminum acetylacetonate, and the like. The metal acetylacetonates herein are generally quite effective when employed at a level of from about $4.0\times10^{-6}$ to $1.0\times10^{-3}$ parts by weight per part by weight of diesel fuel. It is preferred to incorporate from about $5.0\times10^{-6}$ to about $1.0\times10^{-5}$ parts by weight of metal acetylacetonate parts by weight of fuel. If soluble in diesel fuel, the metal acetylacetonate can be incorporated directly therein but more usually, the metal acetylacetonate will be dissolved in one or a mixture of mutual solvents, together with the dinitrotoluene isomer, optionally with one or more detergents, and the resulting solution will be mixed with a minor quantity of base fuel to form an additive concentrate just as in the case of dinitrotoluene alone, *supra*. To demonstrate the combustion particulate-reducing effect of a fuel containing both dinitrotoluene and metal acetylacetonate in accordance with this invention, 1 gallon of the following formulation was employed per 1,000 gallons of diesel fuel (Fuel $A_1$) and compared with an untreated fuel (Fuel B). The results are set forth in Example 4.

| Component | Amount (weight ounces) |
|---|---|
| ferric acetylacetonate | 30 |
| zirconium acetylacetonate | 4 |
| aluminum acetylacetonate | 4 |
| ortho-dichlorobenzene | 56 |
| dimethylformamide | 56 |
| dimethylsulfoxide | 7 |
| toluene | 56 |
| butyl cellosolve | 56 |
| methylene chloride | 128 |
| 80:20 mixture of 2,4-dinitrotoluene and 2,6-dinitrotolueme | 12.5 |
| tricresyl phosphate | 8 |
| Witconate 1840 (sulfonate fatty acid of Witco Chemical Corp.) | 2 |
| triethylamine | 7 |
| Class 2 diesel Oil | 51 gallons<br>55 gallons (approx.) |

EXAMPLE 4

Twenty-five essentially identical diesel tractor-trailer vehicles were evaluated for combustion particulate emissions by operating the vehicles with an untreated fuel (Fuel B) for a period of four weeks, measuring the average particulate emission of the vehicles during this period, and comparing the results with the averaged measured particulate emissions of the same vehicles operated for four weeks with a fuel in accordance with this invention (Fuel $A_1$). Quantitative measurement of the average combustion particulate emissions in each four week period of vehicle operation was made by by-passing a constant amount of vehicle emission exhaust through asbestos filters attached to the tailpipes of the vehicles, with the filters retaining a constant percentage of particulates (i.e., carbon) in the exhaust passing therethrough. At regular periods, the asbestors filters were removed and the carbon deposited upon the filters weighed. Use of Fuel $A_1$ resulted in a calculated 63.5% reduction in particulate material as compared to the particulate material measured over the equivalent period with the use of an untreated diesel oil.

What is claimed is:

1. A fuel for a compression ignition engine containing from about $1.0\times10^{-6}$ to about $1.0\times10^{-3}$ parts by weight of at least one isomer of dinitrotoluene.

2. The fuel of claim 1 containing from about $1.5\times10^{-6}$ to about $1.0\times10^{-5}$ parts by weight of at least one isomer of dinitrotoluene.

3. The fuel of claim 1 or 2 containing 2,4-dinitrotoluene.

4. The fuel of claim 3 wherein the 2,4-dinitrotoluene is in admixture with a minor amount of 2,6-dinitrotoluene.

5. The fuel of claim 1 containing a combustion particulate-reducing amount of at least one metal acetylacetonate.

6. The fuel of claim 5 containing the metal acetylacetonate in an amount of from about $4.0\times10^{-6}$ to about $1.0\times10^{-3}$ parts by weight per part by weight of fuel.

7. The fuel of claim 6 containing the metal acetylacetonate in an amount of from about $5.0\times10^{-6}$ to about $1.0\times10^{-5}$ parts by weight per part by weight of fuel.

8. The fuel of claim 5 wherein the metal acetylacetonate is selected from the group consisting of nickel propionylacetonate, cobaltous propionylacetonate, cobaltic acetylacetonate, ferric acetylacetonate, cerous propionylacetonate, thorium acetylacetonate, zirconium acetylacetonate, chromic acetylacetonate and aluminum acetylacetonate.

9. A method for operating a compression ignition engine which comprises adding to the liquid hydrocarbon fuel employed in the engine, from about $1.0\times10^{-6}$ to about $1.0\times10^{-3}$ parts by weight of at least one isomer of dinitrotoluene.

10. The method of claim 9 wherein the liquid hydrocarbon fuel contains from about $1.5\times10^{-6}$ to about $1.0\times10^{-5}$ parts by weight of at least one isomer of dinitrotoluene.

11. The method of claim 10 wherein the liquid hydrocarbon fuel contains 2,4-dinitrotoluene.

12. The method of claim 11 wherein the 2,4-dinitrotoluene is in admixture with a minor amount of 2,6-dinitrotoluene.

13. The method of claim 9 wherein the liquid hydrocarbon fuel contains a combustion particulate-reducing amount of at least one metal acetylacetonate.

14. The method of claim 13 wherein the liquid hydrocarbon fuel contains the metal acetylacetonate in an amount of from about $4.0\times10^{-6}$ to about $1.0\times10^{-3}$ parts by weight per part by weight of fuel.

15. The method of claim 14 wherein the liquid hydrocarbon fuel contains the metal acetylacetonate in an amount of from about $5.0\times10^{-6}$ to about $1.0\times10^{-5}$ parts by weight per part by weight of fuel.

16. The method of claim 13 wherein the metal acetylacetonate is selected from the group consisting of nickel propionylacetonate, cobaltous propionylacetonate; cobaltic acetylacetonate, ferric acetylacetonate, cerous propionylacetonate, thorium acetylacetonate, zirconium acetylacetonate, chromic acetylacetonate and aluminum acetylacetonate.

* * * * *